United States Patent [19]

Wowczuk et al.

[11] Patent Number: 4,530,434

[45] Date of Patent: Jul. 23, 1985

[54] METHOD AND APPARATUS FOR THE INSPECTION AND SEPARATION OF SYMMETRICAL STABLE UNITS

[75] Inventors: Andrew Wowczuk; William D. Pilesi, both of Monroeville, Pa.

[73] Assignee: U.S. Plastic and Chemical Corp., Putnam, Conn.

[21] Appl. No.: 406,261

[22] Filed: Aug. 9, 1982

[51] Int. Cl.[3] ..... B07C 5/342

[52] U.S. Cl. ..... 209/588; 356/239

[58] Field of Search ..... 209/588; 250/223 R; 356/239

[56] References Cited

U.S. PATENT DOCUMENTS 4,196,811 4/1980 Pilesi et al. ..... 209/588

*Primary Examiner*—Robert B. Reeves

*Assistant Examiner*—Edward M. Wacyra

[57] ABSTRACT

An improved method and apparatus for the inspection and sorting of buttons and the like. The buttons to be inspected are fed from a feeder to a mechanical conveyance system which imparts a velocity to and a spacing between the buttons. The buttons are conveyed between a light source and detector, and the light from the source is masked to limit it to the central zone of the button. The light passing through the central zone is converted to an electrical signal by the detector. The signal value, which is a measure of button quality, is independent of velocity and time is compared to preset limits. In addition, a counter circuit determines the symmetry of the buttons. If the signal is within the limits an accept signal is generated, which cooperates in the control operation of the reject mechanism to automatically separate the acceptable and unacceptable buttons. Additionally, the detector in the vicinity of the mechanism which generates an electrical control signal to activate the reject mechanism only when a button is in the proper position relative to the reject mechanism.

7 Claims, 6 Drawing Figures

81T46

METHOD AND APPARATUS FOR THE INSPECTION AND SEPARATION OF SYMMETRICAL STABLE UNITS

BACKGROUND OF THE INVENTION

1. Field of the Invention:

This invention relates to the inspection and separation of geometrically symmetrical stable units such as buttons, and more particularly to the inspection of the central zone of such units for defects and the automatic separation of the defective buttons for acceptable buttons.

2. Description of the Prior Art:

When a button is manufactured, threadholes, or eyes, are placed in the central zone of the button. Every button manufactured does not have the holes or eyes formed so perfectly that the button can be used on a garment. For example, the holes may be partially closed, improperly spaced, or missing entirely. In addition, since buttons are generally now sewn on garments by automatic machinery, the defective hole pattern can cause a break-down of the machinery with the resulting down-time causing a loss of productivity. Therefore, buttom makers have been required to inspect buttons after manufacture to insure that those sold to garment manufacturers meet commercial standards. To the present time, most buttons are inspected by the human eye as the buttons pass on conveyor belts before the workers charged with the task. Visual inspection has proven to be necessarily tedious work and an ineffecient method of inspection.

Various schemes have been proposed for the automatic inspection and separation of buttons. One such scheme is shown in U.S. Pat. No. 3,956,636. Another, employing laser technology and computers, has also been proposed. The initial cost and the problems of maintenance of such a high technology system make it of doubtful commercial practicality. A third system is shown in U.S. Pat. No. 4,196,811. While this third system has proved accurate and efficient, calibration problems arose because each button must move at a predetermined velocity and be exposed to the light source for a predetermined time. The need for frequent calibration has detracted from the commercial viability of this system.

Accordingly, it is an object of the present invention to provide an economical and reliable method and apparatus for the inspection and separation of buttons which does not require frequent calibration or precision in velocity and spacing, thereby eliminating the need for the presence of a skilled technician during the inspection process.

SUMMARY OF THE INVENTION

The present invention overcomes the foregoing problems of the prior art by providing a method and apparatus that analyzes button quality independently of the velocity at which the button moves and the time it is present at the inspection point. Further, the present invention prevents either premature or delayed operation of the reject mechanism.

In the present invention, a controlled beam of light is passed through the button being conveyed on the velocity and spacing system to a detector-system. The light input received by the detector-sensor is converted to a voltage by the circuitry of the detector-sensor and is then amplified by AMP, and referenced to a signal generated by an AMBIENT LIGHT ISOLATOR to minimize interference from variations in ambient light levels which can occur near the transmitted frequency. The signal is then demodulated through an active filter which passes all frequencies up to approximately 6 khz. The signal is again amplified and this output is the characteristic wave form for the button. The generated wave form is passed to the BUFFER ISOLATOR to separate the analysis and generation section of the electronics. The wave form is then directed to the COMPARATOR, DIFFERENTIATOR and PEAK VALUE GENERATOR (PVG). The COMPARATOR generates a pulse encompassing the wave form when the wave form passes a preset threshold voltage. The output then starts TIMER I and TIMER II and controls the output of the PEAK ENCOMPASSING PULSE GENERATOR (PIPG). The output in TIMER I clears the sample and hold circuit of the PEAK VALUE GENERATOR and also clears the FLIP FLOP I AND II of the PIPG. The output of the DIFFERENTIATOR is the derivative of the wave form and is converted to two pulses by a SCHMIDT TRIGGER (ST) circuit which in turn produces a peak encompassing pulse in the PIPG. The circuitry of the PIPG generates a pulse that will encompass the center of the button wave form independent of button velocity. This generated peak encompassing pulse determines the time interval during which the PVG measures the voltage in the center of the wave form. The output of the PVG is compared by the QUALITY DISCRIMINATOR (QD) to two preset values. The output of the QD is one input to the rejection circuit.

The reject mechanism circuitry receives five independent inputs: (a) pulse from the light source detector which indicates the introduction of a button into the rejection area; (b) the foregoing peak encompassing pulse; (c) the signal developed by the QD; (d) the pulse from the ST; and (e) a Timer I pulse to clear the pulse counter circuit. The signal from (a) is one input to the NOR GATE, IC303, the second input, comes from a logic circuit combining inputs (b) through (c).

The criteria for activating the reject mechanism is comprised of three inputs: the signal from the QD indicating an acceptable peak voltage, and/or the signal from the pulse counter indicating the button is unsymmetrical and, the signal from the proximity detector indicating that the button is in a position to be rejected.

DESCRIPTION OF THE PREFERRED EMBODIMENT

Figure 1:
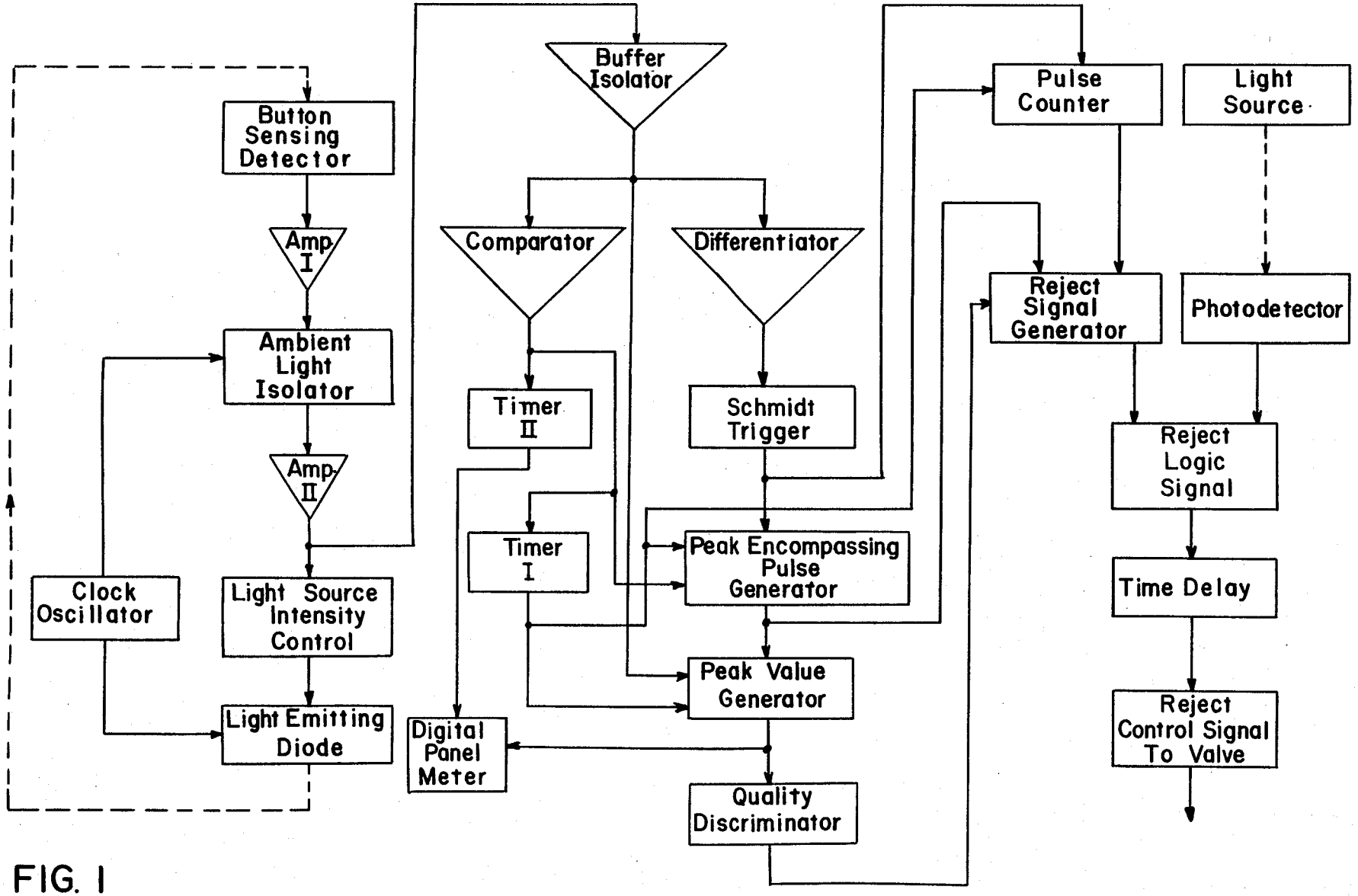
FIG. 1 is a block flow diagram of the method and apparatus of the present invention.
Figure 2:
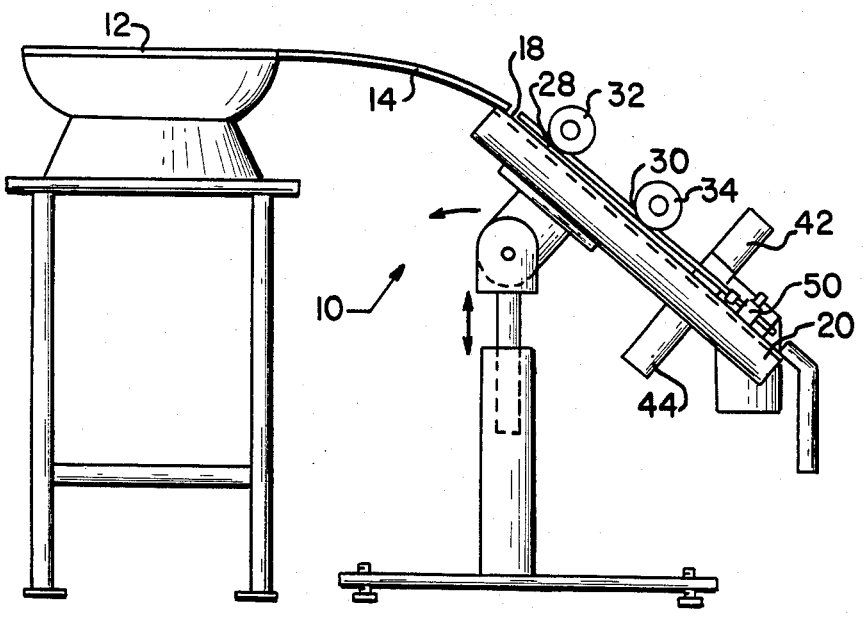
FIG. 2 is an elevational view of the feed, velocity control, spacing, inspection and rejection system of the present invention.
Figure 3:
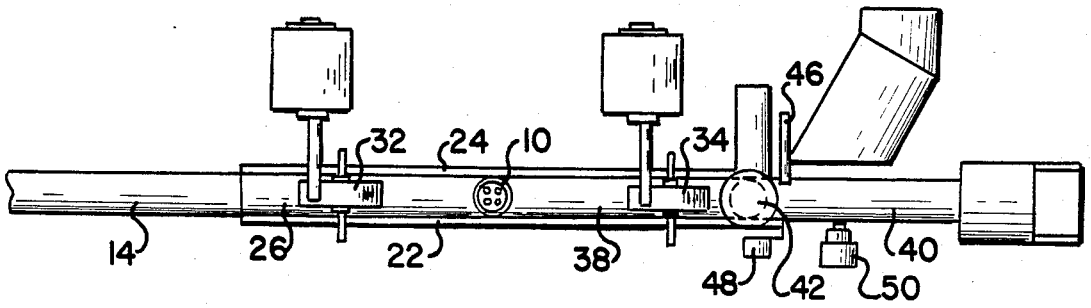
FIG. 3 is a top view of the system of FIG. 2.

Referring to FIGS. 2 and 3, buttons 10 to be inspected are fed from the vibratory feeder 12 by means of spring chute 14 which is made of steel spring wire and is rectangular in cross-section. Chute 14 is attached to feeder 12 by means of a hanger bracket, not shown. The feed rate of the buttons to surface 18 of the velocity control and spacing system is approximately 8 to 10 buttons per second but the inspection rate is limited by the mechanics of available feeders. Surface 18 is made of glass and is mounted in an appropriate slot in base plate 20. Chute 14 terminates within side guides 22 and 24 and the first velocity control wheel 32. Guides 22 and 24 which may be made of metal are fixed to surface 18 by suitable means such as screws passing through slots in surface 18 (not shown). The guides 22 and 24 have indent portions 28 and 30 immediately below the two velocity control wheels 32, 34. Indent portions 28 and 30 in the emobidment shown are approximately 0.080 inch high to allow the velocity control wheels to frictionally engage the upper flat surface of the buttons being tested. The remaining portion of guides 22 and 24 is higher than the buttons. Securing guides 22 and 24 to surface 18 by screws passing through slots in surface 22 has the advantage that the spacing between the guides can be varied to accommodate buttons of various diameters. For a button of ligne size 19 which has an outside diameter of 0.474 to 0.482 inch the width of the guides at the upper end of surface 18 would be approximately 0.488 inch. The guides remain parallel throughout their lengths. Generally, the desirable spacing between the guides should be 0.01 greater than the average outside diameter of the particular ligne size to be tested.

Velocity control wheels 32 and 34 as illustrated herein are approximately 6 inches apart, are made of aluminum coated with polyurethane with a surface hardness of approximately 50 durameters, are 3.0 inches in diameter, and are driven by idlers, not shown, by means of directly connected 1800 r.p.m. synchronous motors. Wheels 32 and 34 are both fixed to surface 22 by means of adjustable hangers, not shown, to allow adjustment of the wheels for buttons of different thicknesses. By setting wheels 32 and 34 to the proper height, sufficient contact between the button and wheels is assured so that a uniform velocity is imparted to the buttons. For example, a button of ligne size 19 with a finished thickness of approximately 0.097 inch, the height of the wheels above the surface 18 would be 0.089 inch and for a ligne size F14 button having a finished thickness of approximately 0.093 inch, the height of the wheels above surface 18 would be 0.085 inch.

Cover 39 extends the width of guides 24 from the downstream end of indent 28 to the upstream end of indent 30. Cover 40 extends from downstream of wheel 34 past the reject valve 50 of the reject mechanism and is supported by a bracket at the downstream end of surface 22. Reject valve 50 is a commercially available high speed solenoid valve which is conrolled by the reject electronics. The cover is transparent and in the illustrated embodiment is approximately 0.125 inch thick, and can be fixed to guides 22 and 24 in any conventional manner. The cover is slotted in the areas where the velocity control wheels contact the buttons.

Fastened above surface 18 is an LED 42 which emits infrared light at approximately 0.93 microns wavelength. The light is adapted to pass through a variable iris which effectively contours the light beam by masking out that portion of the light emmited which would be outside the central zone of the buttons being inspected. This is because the outside diameter of buttons varies causing noise signals which lower the sensitivity of the inspection system. Other objects may be inspected without an iris if their outside diameters or dimensions are all exactly the same. The light passes through the glass cover over the side guides 22 and 24 and through the central zone of the button through a spectral filter to the surface of the button sensing detector 44 which is mounted beneath surface 18 on base plate 20 in a conventional manner. Mounted downstream of this area on one side of surface 18 is a second light source 46. Mounted on the opposite side of surface 18 is a pinpoint photo detector 48. Detector 48 sends a signal to the reject control circuit when a button enters the area for rejection.

Figure 4:
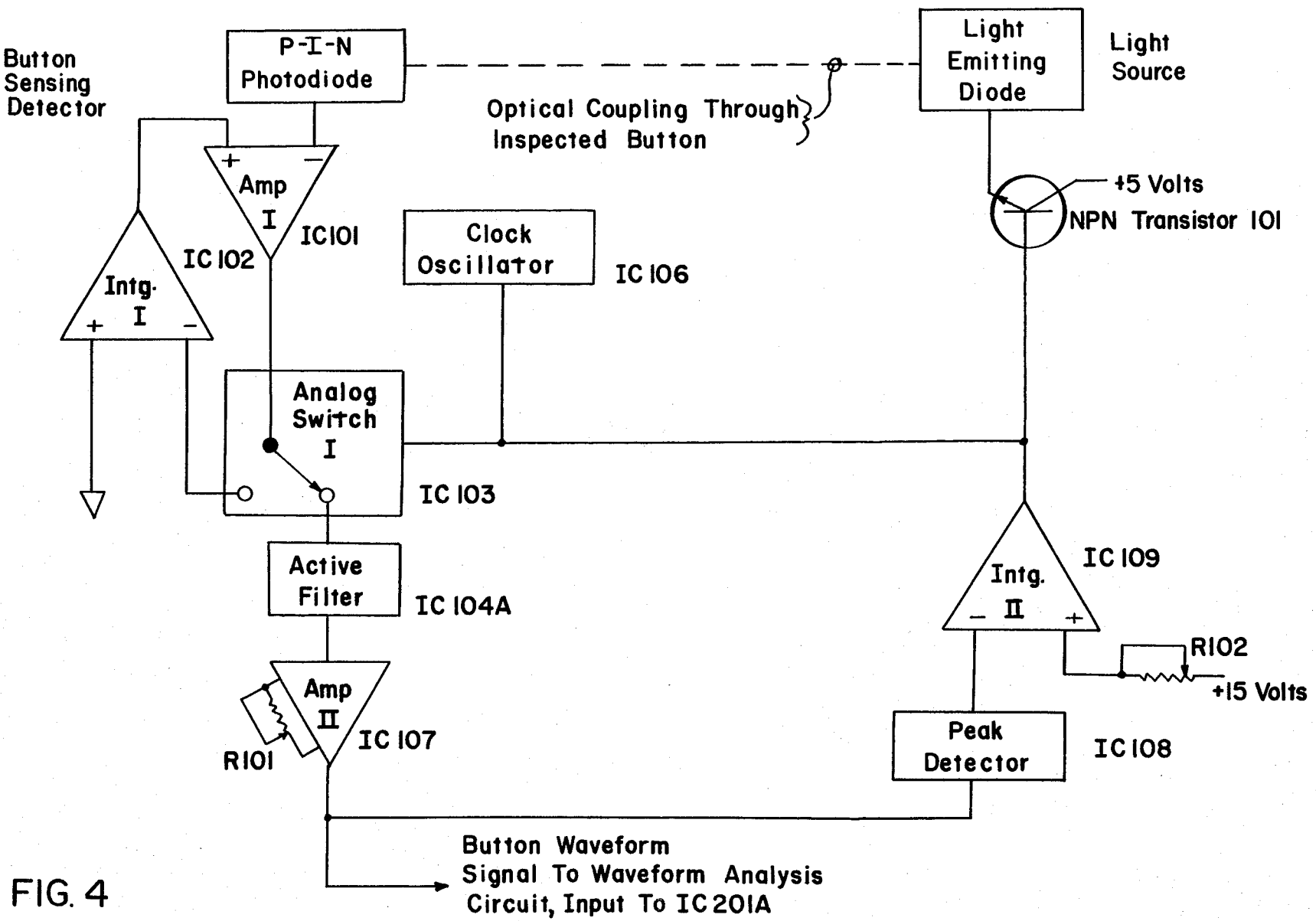
FIG. 4 is a block diagram of the wave form generation circuit of the present invention.

The circuit of FIG. 4 contains two elements to insure the signal received by detector 4 is a true signal. One element, the Ambient Light Isolator includes Clock Oscillator IC106, AMPI, Analog Switch 1, which acts as a chopper, Integrator I, and Active Filter IC104A. These components demodulate the light source signal by subtracting background light measured when the LED is off from the signal when the LED is on. The other element, the Light Source Intensity Control includes, Peak Detector, Integrator II, Reference Level Signal R102, which is set to a predetermined voltage normally 10 volts D.C., and the LED driver transitor 101. These components make slight changes to the intensity of the LED to correct for dirt accumulating in the light path. The signal received by the detector is transformed by the circuit into a characteristic wave form for the button inspected so that the output of AMP II is the connected wave form used for analysis.

Figure 5:
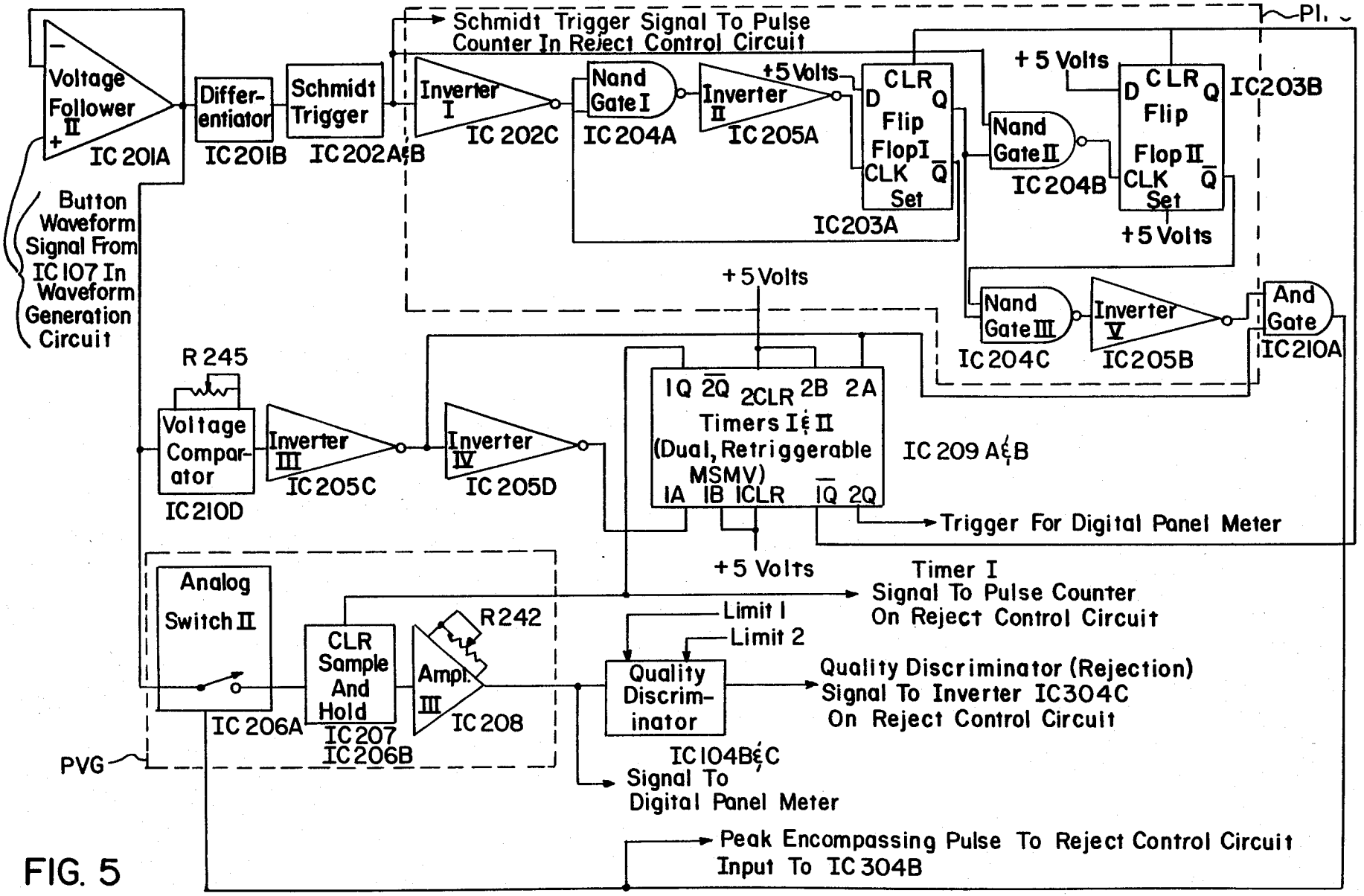
FIG. 5 is a block diagram of the wave form analysis circuit of the present invention.

The output of AMP II is taken to Buffer Isolator, IC201A, FIG. 5. The output of IC201A is directed to three elements of the wave form analysis circuit, the Differentrator, Comparator, and the Peak Value Generator. In the Comparator consisting of IC210D, IC205C and IC205D, the pulse encompassing the characteristic wave form is generated when the wave form passes the threshold voltage set by R245, normally 8 volts, IC205C and IC205D modify the pulse to TTL levels suitable for initiating timers I and II and controlling the output of the PIPG. Timer I is activated by the leading edge of the pulse generated by the Comparator. The two outputs of Timer I are used to clear the sample and hold circuit of the PVG and to clear Flip Flops 1 and 2 of the PIPG. The output used to clear the PVG is an input to the Reject Control Circuit.

The output of the Differentrator IC201B is a derivative of the characteristic button wave form. This signal shows the wave form inflection points. The output of the Differentrator is converted to two pulses by the Schmidt Trigger (ST) and the output of the ST is used to produce a peak encompassing pulse in the PIPG. The pulse generated by the PIPG encompasses the center peak of the button wave form independent of the velocity of the button at the time of inspection. The output of the PIPG and Comparator are combined by AND Gate I and form one of the inputs to the PVG. The two inputs to the PVG cause it to generate a voltage equal to the peak voltage of the center of the characteristic wave form. This signal is the input for the Quality Discriminator (QD) and is also displayed on a digital voltmeter and is the measure of Button Quality. The QD output is used in the Reject Control Circuit and is based on the preset limits 1 and 2. The preset voltage limits are determined experimentally by checking the voltage range for good buttons selected from a sample of a new batch of buttons to be inspected. Timer II is activated by the trailing edge of the Comparator pulse and is used to trigger the digital display of the wave form value as obtained in the PVG.

Figure 6:
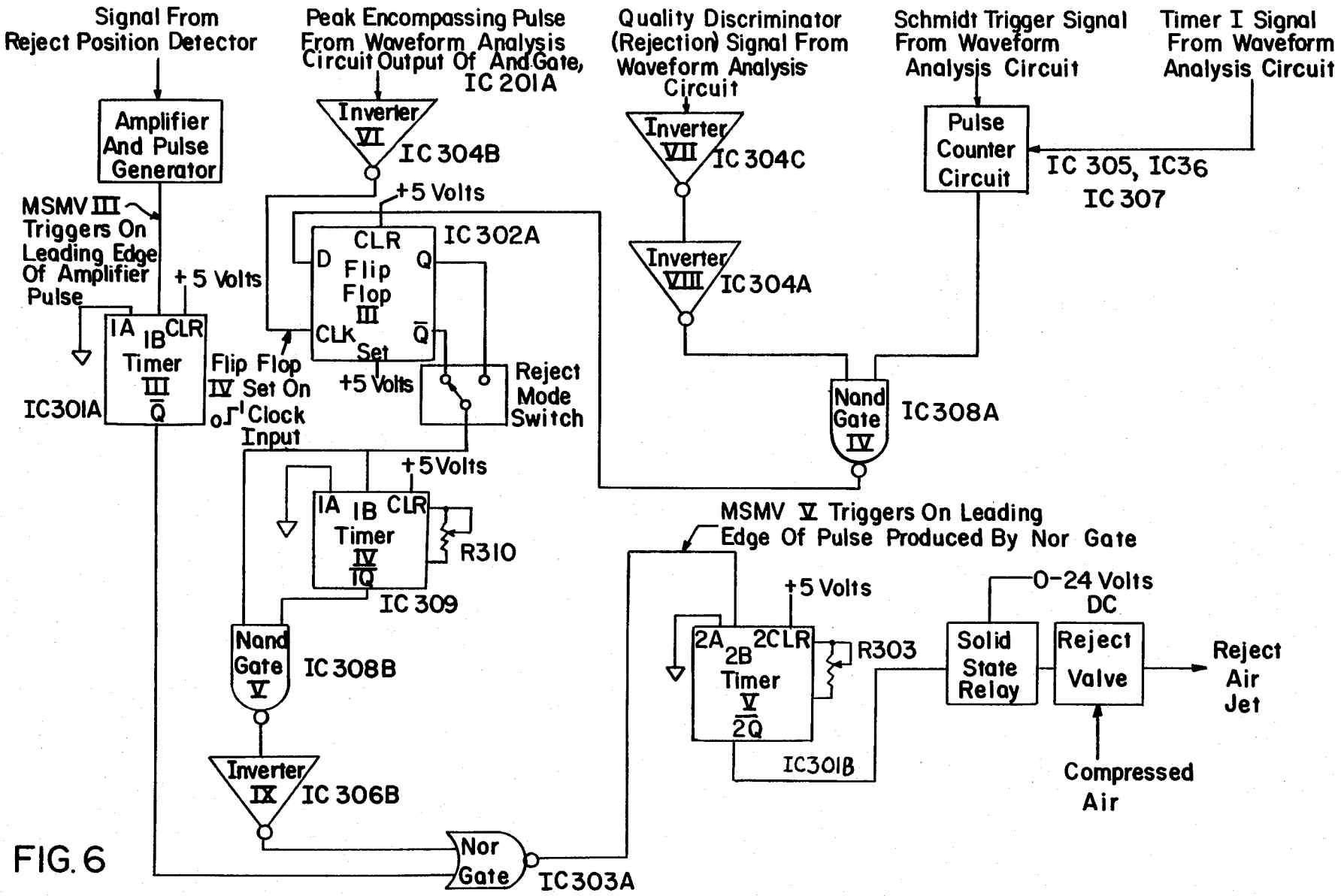
FIG. 6 is a block diagram of the button rejection circuit of the present invention.

The Reject Control Circuit, FIG. 6, controls the operation of the reject mechanism. The Circuit has five (5) inputs which are interpreted to control the mechanism as shown in FIG. 6. The first input triggers Timer III and the output of Timer III is one input to NOR Gate, IC303A. The second imput to the NOR Gate comes from the logic circuit which combines the remaining inputs to the Reject Control Circuit. This logic circuit compensates for NON-UNIFORM spacing between the buttons being ispected by inclusion of Timer IV which assumes correct activation of the reject mechanism. The output of the NOR GATE is the input of Timer V which generates a signal to determine activation of the reject mechanism. The reject mechanism will not be activated if of the five (5) input signals all are in the acceptable state for a good quality, symmetrical button.

The reject mechansim 50 is a solenoid operated air valve activated by the Reject Control Circuit. The Reject Mode Switch enables the air valve to either deflect the path of travel of good or unacceptable buttons. A blast of air deflects the chosen buttons from a straight line of travel into a special chute.

While we have described a certain preferred embodiment of our invention, it is understood it can be otherwise embodied within the scope of the following claims.

What is claimed:

1. Apparatus for the inspection of symmetrical stable units comprising:

(a) velocity and spacing control means for imparting a velocity to and a space between said units as they travel in a single line;

(b) first light emitting means operably mounted with respect to said control means, said light emitting means adapted to pass a light through said units;

(c) first detector means for detecting said light after it has passed through said units;

(d) first means for generating a wave form characteristic of the unit being inspected;

(e) second means for generating a pulse encompassing the wave form and comparing said pulse to pre-set values;

(f) third means for generating a signal which depicts the relative position of said units on said apparatus;

(g) said second means and third means generating a plurality of order signals; and (h) means responsive to said order signals to selectively determine the further path of travel of the unit being inspected.

2. The apparatus of claim 1 wherein said light emitting means includes a variable diameter iris adapted to restrict the diameter of the light beam emitted so as to limit said light beam to a portion of the surface area of said units.

3. The apparatus of claim 1 wherein said third means include a second light source and second detector means for determining when a unit is in close proximity to the means responsive to said order signals.

4. The apparatus of claim 1 wherein said first light emitting and detector means include means of correcting the intensity of said light when it varies due to ambient light or particulates in the path between said light emmitting means and detector means.

5. The apparatus of claim 1 wherein the means for determining the further path of travel of said units includes a solenoid air valve adapted to selectively displace selected units from their path of travel.

6. The apparatus of claim 1 wherein the velocity and spacing control means comprises:

(i) an inclined surface made from glass or the like;

(ii) side guides adjustably fixably attached to said inclined surface, said side guides adapted to receive said units and act as a conduit therefor over a portion of the length of said inclined surface;

(iii) a plurality of velocity control wheels adjustably fixably mounted above said inclined surface, said wheels adapted to frictionally engage said units and impart a velocity to and a space between said units; and (iv) motor means for driving each of said velocity control wheels at a preset constant speed.

7. The apparatus of claim 6 wherein a cover means spans the width of said side guides before, between, and after said velocity control wheels.

* * * * *

UNITED STATES PATENT AND TRADEMARK OFFICE

CERTIFICATE OF CORRECTION

PATENT NO. : 4,530,434

DATED : July 23, 1985

INVENTOR(S) : Andrew Wowczuk, et al.

It is certified that error appears in the above-identified patent and that said Letters Patent are hereby corrected as shown below:

Column 3, line 15, "emobiment" should be --embodiment--.

Column 3, line 61, "an LED42" should be --a LED 42--.

Column 4, line 25, "transitor" should be --transistor--.

Column 5, line 10, "imput" should be --input--.

Column 5, line 23, "mechansim" should be --mechanism--.

Signed and Sealed this

Fifteenth Day of March, 1988

*Attest:*

*Attesting Officer*

DONALD J. QUIGG

*Commissioner of Patents and Trademarks*